US006941985B2

(12) United States Patent
Kondo et al.

(10) Patent No.: US 6,941,985 B2
(45) Date of Patent: Sep. 13, 2005

(54) DRIVE DEVICE FOR PACKAGING MACHINE

(75) Inventors: Masakatsu Kondo, Tokushima (JP); Takayoshi Kamiji, Tokushima (JP); Kenji Matsumoto, Tokushima (JP)

(73) Assignee: Shikoku Kakoki Co., Ltd., Itano-gun (JP)

( * ) Notice: Subject to any disclaimer, the term of this patent is extended or adjusted under 35 U.S.C. 154(b) by 140 days.

(21) Appl. No.: 10/633,537

(22) Filed: Aug. 5, 2003

(65) Prior Publication Data

US 2004/0065048 A1 Apr. 8, 2004

(30) Foreign Application Priority Data

Aug. 7, 2002 (JP) ..... 2002-230483

(51) Int. Cl.[7] ..... B65B 3/26

(52) U.S. Cl. ..... 141/276; 141/94; 141/156; 141/160; 141/277

(58) Field of Search ..... 141/94, 98, 140–148, 141/156–162, 275–278

(56) References Cited

U.S. PATENT DOCUMENTS 4,142,561 A * 3/1979 Bennett et al. ..... 141/82
5,067,531 A * 11/1991 Herzog ..... 141/116
6,761,191 B2 * 7/2004 Rosen et al. ..... 141/91

* cited by examiner

*Primary Examiner*—Timothy L. Maust
(74) *Attorney, Agent, or Firm*—Armstrong, Kratz, Quintos, Hanson & Brooks, LLP

(57) ABSTRACT

A drive device comprises an air cylinder 123 for causing an operating member for a packaging operation to perform a reciprocating motion, a sensor 132 for detecting the cycle velocity or time of the air cylinder 123, a control valve 222 for controlling the pressure or flow rate of the fluid to be supplied to the air cylinder 123, and an a sequencer 201 for setting a reference value SV corresponding to the cycle velocity or time of the air cylinder 123, receiving a value PV detected by the sensor 132 as an input, calculating a valve opening degree so as to reduce the deviation of the detected value PV from the reference value SV to zero and setting the opening degree of the control valve 222 based on the calculated valve opening degree.

6 Claims, 12 Drawing Sheets

DRIVE DEVICE FOR PACKAGING MACHINE

BACKGROUND OF THE INVENTION

The present invention relates to drive devices for use in packaging machines, for example, for intermittently transporting containers, filling contents into the containers during transport and sealing off the filled containers, the drive device being adapted to drive an operating member for the packaging operation.

Already known as such drive devices are those comprising mechanical means such as a cam, those comprising a servo motor or like motor and those comprising a fluid pressure actuator such as an air cylinder.

Drive devices wherein a cam or like mechanical means is used are suitable for causing an operating member to perform an accurate movement but have the problem of being complex in construction or requiring labor and time for altering the operation curve.

Drive devices comprising a servo motor of like motor permit an accurate movement, are usable with an altered operation curve which is easy to prepare, and are therefore placed into use in recent years in place of drive devices comprising a cam or like mechanical means. However if many drive devices comprising a servo motor or the like are used, there arises the problem that the packaging machine becomes expensive in its entirety.

Although inexpensive, drive devices comprising an air cylinder or like fluid pressure cylinder are not comparable to the drive devices of the above two types with respect to operation stability, require much labor for adjustment and therefore have the problem that the operating members usable with the drive device are limited.

SUMMARY OF THE INVENTION

An object of the present invention is to provide a fluid pressure actuator which is usable for a wider variety of applications as a drive device for operating members of packaging machines so as to achieve a reduction in the overall cost of the packaging machine, and which is improved in operation stability and greatly reduced in the labor required for the adjustment of the actuator as a drive device.

The present invention provides a drive device for use in a packaging machine having an operating member for a packaging operation. The drive device comprises a fluid pressure actuator for causing the operating member to perform a reciprocating motion, a sensor for detecting the cycle velocity or time of the actuator, a control valve for controlling the pressure or flow rate of a fluid to be supplied to the actuator, and control means for setting a reference value corresponding to the cycle velocity or time of the actuator, receiving a value detected by the sensor as an input, calculating a valve opening degree based on the deviation of the detected value from the reference value and setting the calculated valve opening degree as the opening degree of the control valve.

With the drive device of the invention, the cycle velocity or time of the actuator is detected by a sensor, and control means calculates the deviation of the value detected by the sensor from a preset reference value, determines a valve opening degree based on the calculated deviation and operates the control valve with the valve opening degree thus determined. Accordingly, the actuator can be operated with the predetermined cycle velocity or time. Further the cycle velocity or time can be automatically adjusted to greatly reduce the labor and time otherwise required for the adjustment.

For use in a packaging machine having an operating member for a packaging operation, the present invention provides another drive device comprising a fluid pressure actuator for causing the operating member to perform a reciprocating motion, a sensor for detecting cycle timing of the actuator, an on-off valve for on/off-controlling a fluid to be supplied to the actuator, and control means for setting a reference value corresponding to the cycle timing of the actuator, receiving a value detected by the sensor as an input, calculating cycle timing based on the deviation of the detected value from the reference value and setting the calculated cycle timing as the cycle timing of the on-off valve.

With the second-mentioned drive device of the invention, the cycle timing of the actuator is detected by a sensor, and control means calculates the deviation of the value detected by the sensor from a preset reference value, determines cycle timing based on the calculated deviation and operates the on-off valve with the cycle timing thus determined. Accordingly, the actuator can be operated with the predetermined cycle timing. Further because the cycle timing is adjustable automatically, the labor and time otherwise required for the adjustment can be greatly diminished.

For use in a packaging machine having an operating member for a packaging operation, the present invention provides another drive device comprising a fluid pressure actuator for causing the operating member to perform a reciprocating motion, a sensor for detecting cycle timing of the actuator, an on-off valve for on/off-controlling a fluid to be supplied to the actuator, calculating means for setting a reference value corresponding to the cycle timing of the actuator, receiving a value detected by the sensor as an input and calculating the deviation of the detected value from the reference value every cycle, and control means for calculating the average value of the deviations of a plurality of cycles calculated by the calculating means, calculating cycle timing based on the calculated average value and setting the calculated cycle timing as the cycle timing of the on-off valve.

With the third-mentioned drive device of the invention, the cycle timing is calculated based on the average value of the deviations of a plurality of cycles. This ensures more stabilized control than when the cycle timing is calculated every cycle.

For use in packaging machine having an operating member for a packaging operation, the invention provides another drive device comprising a fluid pressure actuator for causing the operating member to perform a reciprocating motion, a sensor for detecting the cycle velocity or time of the actuator and detecting cycle timing of the actuator, a control valve for controlling the pressure or flow rate of a fluid to be supplied to the actuator, an on-off valve for on/off-controlling the fluid to be supplied to the actuator, control means for setting an operating time reference value corresponding to the cycle velocity or time of the actuator and a timing reference value corresponding to the cycle timing of the actuator, receiving an operating time value and a timing value detected by the sensor as inputs, calculating a valve opening degree based on the deviation of the detected operating time value from the operating time reference value and cycle timing based on the deviation of the detected timing value from the timing reference value, and setting the calculated valve opening degree as the opening degree of the control valve and the calculated cycle timing as the cycle timing of the on-off valve.

With the fourth-mentioned drive device of the invention, the cycle velocity or time and the cycle timing can be set at the same time.

Preferably, the fluid pressure actuator is an air cylinder or a rotary actuator.

The operating member may be one of a piston rod of a fluid pressure cylinder, a container lift rod of a lifter and a movable rod of a top heater for pivotally moving a heater unit.

DESCRIPTION OF THE PREFERRED EMBODIMENTS

Figure 1:
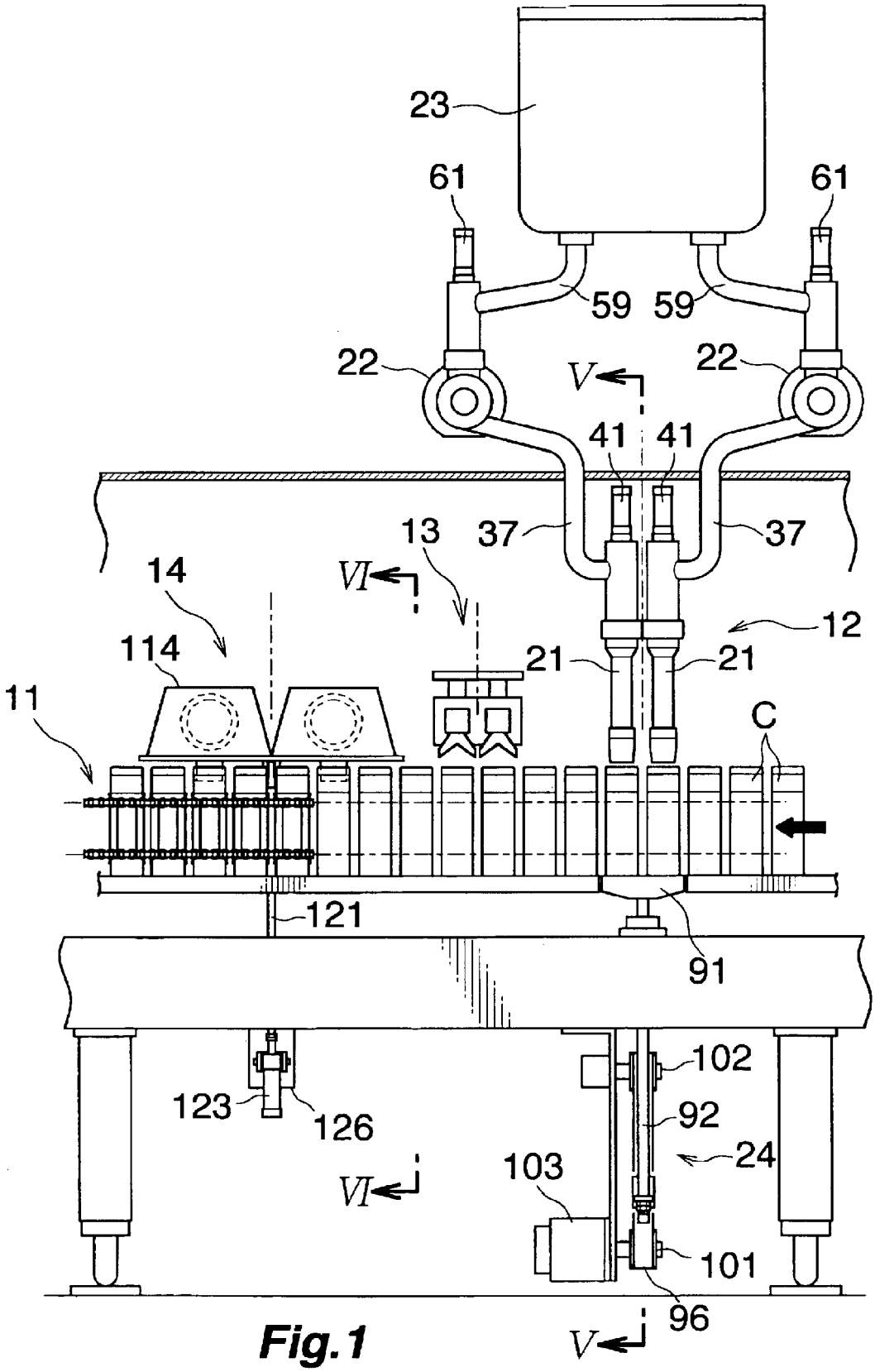
FIG. 1 is a side elevation showing a filling apparatus and a top heater which are equipped with a drive device of the invention.

Embodiments of the invention will be described below with reference to the drawings.

In the following description, the terms "front" and "rear" are used based on FIG. 1; the left-hand side of the drawing will be referred to as "front," and the opposite side thereof as "rear." The terms "left" and "right" are used for the device as it is seen from behind.

FIG. 1 shows a conveyor 11 for forwardly transporting containers C, having a bottom and rectangular to square in cross section, intermittently, two at a time, and a filling apparatus 12, top breaker 13 and top heater 14 which are arranged in this order from the rear forward along the path of transport by the conveyor.

The filling apparatus 12 and the top heater 14 are driven by the drive device of the invention in which a fluid pressure actuator is used.

The filling apparatus 12 comprises two filling nozzles 21 arranged above the path of transport of containers in corresponding relation with the two containers to be transported in one cycle, two metering cylinders 22 each adapted to feed to the filling nozzle 21 the liquid to be filled in a specified quantity at a time, a tank 23 containing the liquid to be fed to the metering cylinders 22 and a lifter 24 for raising the containers C from the conveyor 11 for filling.

Figure 2:
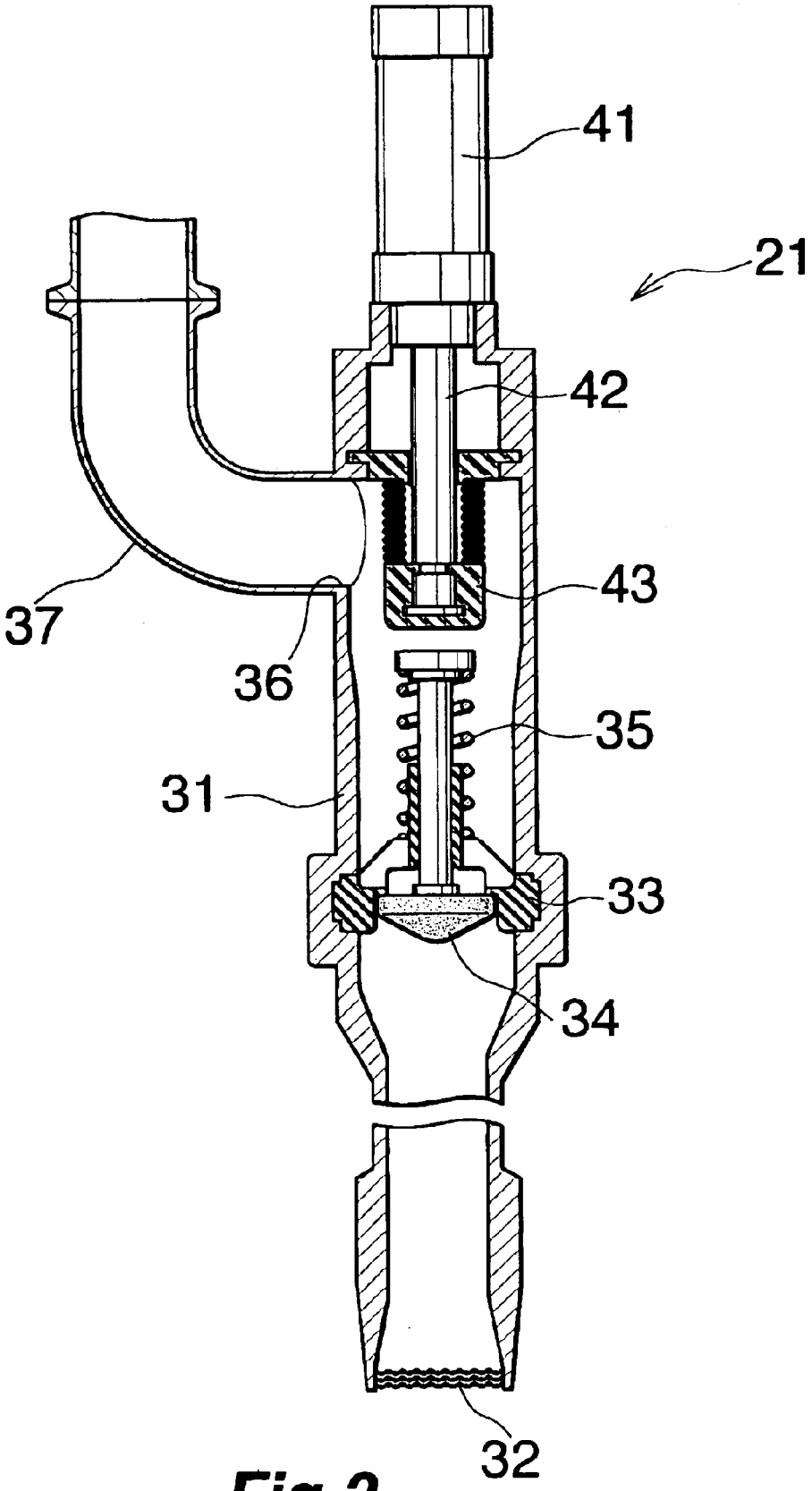
FIG. 2 is a vertical longitudinal view of a filling nozzle of the filling apparatus.

As shown in FIG. 2, each filling nozzle 21 comprises a vertical tubular nozzle body 31, and a dripping preventing member 32 in the form of a metal net and covering a lower-end discharge opening of the nozzle body 31.

A lower seat ring 33 is disposed in the nozzle body 31 approximately at the middle of the height thereof. The seat ring 33 is provided with a lower chuck valve 34 in the form of a mushroom, brought into intimate contact with the ring 33 from below and biased upward by a lower spring 35. The nozzle body 31 is provided close to the top thereof with an inlet 36 having joined thereto an outlet end of a lower connecting pipe 37.

A lower air cylinder 41 facing downward is mounted on the top of the nozzle body 31 and has a lower piston rod 42 advancing into the nozzle body 31. A lower depressing member 43 is attached to the lower end of the piston rod 42.

The lower piston rod 42 is in a retracted position in FIG. 2. The lower depressing member 43 is opposed to the upper end of valve stem of the lower chuck valve 34 and spaced apart therefrom by a small distance. When the lower piston rod 42 is advanced by the operation of the lower air cylinder 41, the depressing member 43 is moved down, depressing the valve stem to open the lower chuck valve 34.

Figure 3:
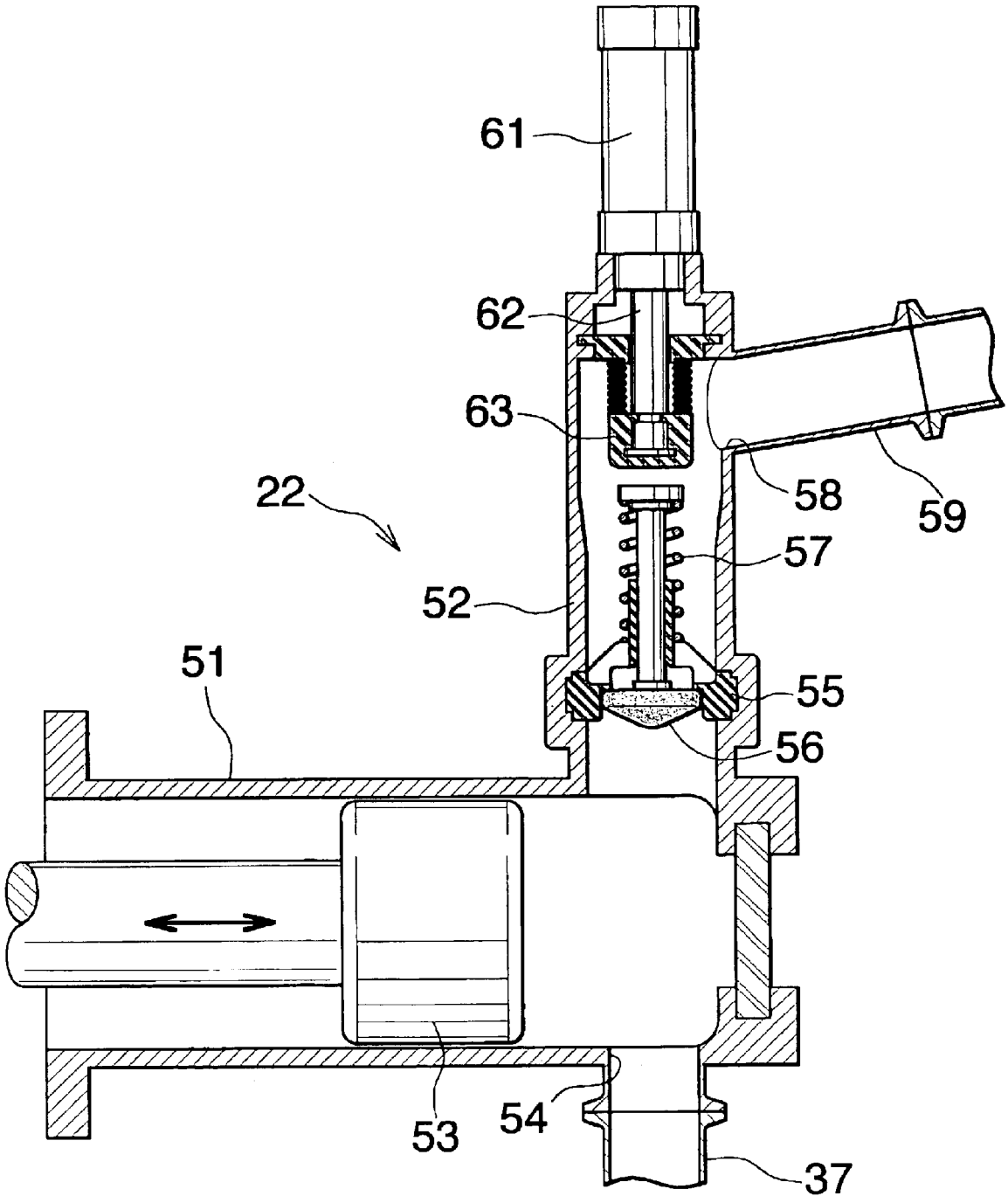
FIG. 3 is a vertical longitudinal view of a metering cylinder of the filling apparatus.

With reference to FIG. 3, the metering cylinder 22 comprises a horizontal cylinder body 51, a vertical tubular inlet chamber 52 extending upward from and communicating with an upper end of right end portion of the cylinder body 51, and a piston 53 housed in the cylinder body 51.

An outlet 54 facing downward is provided at a lower end of right end portion of the cylinder body 51 and has connected thereto an inlet end of the lower connecting pipe 37.

An upper seat ring 55 is provided in the inlet chamber 52 close to its lower end. The seat ring 55 is provided with an upper chuck valve 56 in the form of a mushroom, brought into intimate contact with the ring 55 from below and biased upward by an upper spring 57. The inlet chamber 52 is provided close to the top thereof with an inlet 58 having joined thereto an outlet end of an upper connecting pipe 59. The upper connecting pipe 59 has an inlet end connected to the tank 23.

An upper air cylinder 61 facing downward is mounted on the top of the inlet chamber 52 and has an upper piston rod 62 advancing into the body of the inlet chamber 52. An upper depressing member 63 is attached to the lower end of the piston rod 62.

The upper piston rod 62 is in a retracted position in FIG. 3. The upper depressing member 63 is opposed to the upper end of valve stem of the upper chuck valve 56 and spaced apart therefrom by a small distance. When the upper piston rod 62 is advanced by the operation of the upper air cylinder 61, the depressing member 63 is moved down, depressing the valve stem to open the upper chuck valve 56.

When the piston 53 is moved leftward from the position shown in FIG. 3, an internal negative pressure is produced within the cylinder body 51. The upper chuck valve 56 tends to open under the negative pressure produced, but before this, the upper chuck valve 56 is opened in advance. This urges the upper chuck valve 56 to open smoothly under the negative pressure produced.

When the upper chuck valve 56 is opened and the piston 53 is moved leftward, the liquid within the tank 23 flows into the cylinder body 51 through the inlet chamber 52. Before the piston 53 is moved rightward from the left limit position of its stroke, the upper chuck valve 56 is closed and the lower chuck valve 34 is opened. The rightward movement of the piston 53 causes the liquid in the metering cylinder 22 to flow out therefrom into the filling nozzle 21 and further flow out of the discharge opening of the nozzle to fill the container C.

Figure 4:
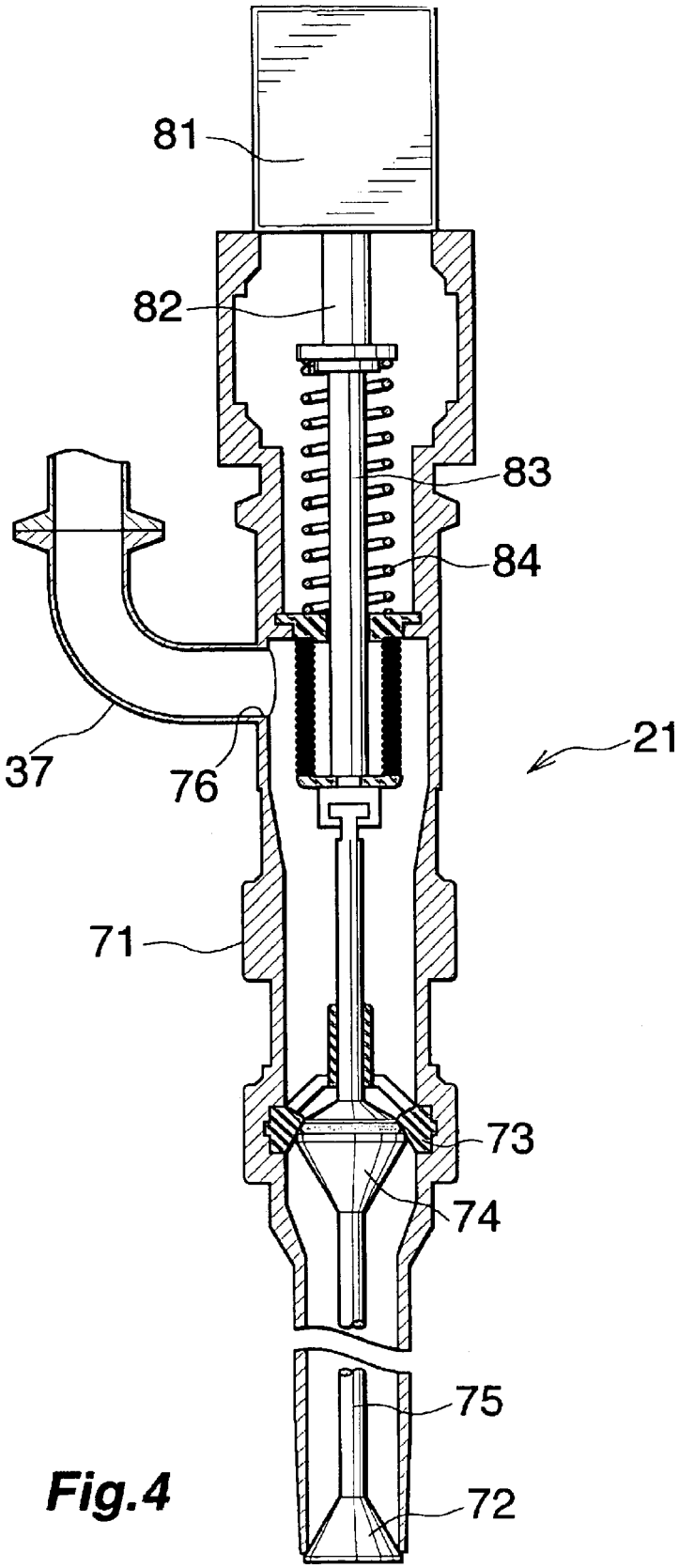
FIG. 4 is a sectional view corresponding to FIG. 2 and showing a filling nozzle different from the nozzle shown in FIG. 2.

FIG. 4 shows a filling nozzle 21 different from the nozzle 21 shown in FIG. 2.

The filling nozzle 21 comprises a vertical tubular nozzle body 71, and a conical opening-closing member 72 provided at a lower-end discharge opening of the nozzle body 71.

A lower seat ring 73 is disposed in the nozzle body 71 approximately at the middle of the height thereof. The seat ring 73 is provided with a lower chuck valve 74 in the form of a mushroom and brought into intimate contact with the ring 73 from below. The opening-closing member 72 and the lower chuck valve 74 are interconnected by a vertical connecting rod 75. The nozzle body 71 is provided close to the top thereof with an inlet 76, which has joined thereto the outlet end of the lower connecting pipe 37.

A lower air cylinder 81 facing downward is mounted on the top of the nozzle body 71 and has a lower piston rod 82 advancing into the nozzle body 71. The piston rod 82 has a lower end joined to an upper end of a vertical depressing rod 83. The depressing rod 83 has a lower end connected to an upper end of valve stem of the lower chuck valve 74 and biased upward by a spring 84.

The lower piston rod 82 is in a retracted position in FIG. 4. In this state, the opening-closing member 72 is in intimate contact with the edge defining the discharge opening, and the lower chuck valve 74 is in intimate contact with the seat ring 73. When the lower piston rod 82 is advanced by the operation of the lower air cylinder 81, the depressing rod 83 is moved down, depressing the valve stem to open the lower chuck valve 74. Simultaneously with this, the connecting rod 75 is also depressed, causing the opening-closing member 72 to open the nozzle discharge opening.

Figure 5:
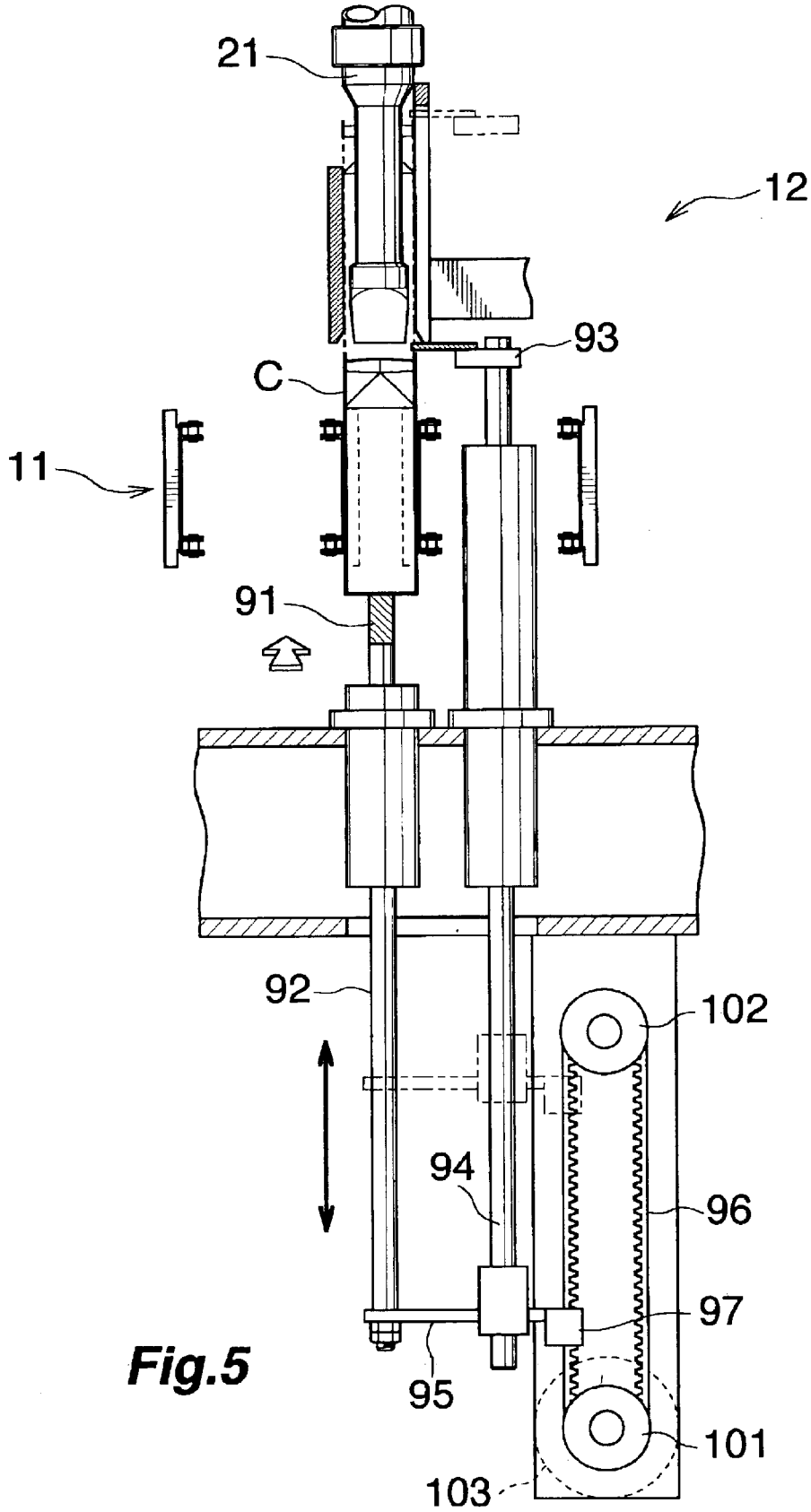
FIG. 5 is a side elevation showing a lifter in section along the line V—V in FIG. 1.

With reference to FIG. 5, the lifter 24 comprises a vertical lift rod 92 having a container holder 91 fixed to the upper end thereof for pushing up the container, a vertical lift rod 93 disposed alongside the rod 92 in parallel thereto and having a container holder 93 fixed to the upper end thereof for pushing down the container, a horizontal connecting member 95 secured to and interconnecting the lower ends of the lift rods 92, 94, an endless belt 96 so disposed that one of vertical paths of linear movement thereof is opposed to the path of vertical movement of the connecting member 95, and an attaching member 97 integral with the connecting member 95 and secured to a portion of the belt 96 which portion is positioned in the path of linear movement.

The endless belt 96 is reeved around a lower drive pulley 101 and an upper driven pulley 102. The drive pulley 101 has connected thereto an output shaft of a rotary actuator 103.

When the output shaft is rotated forward or reversely by the operation of the rotary actuator 103, the belt 96 is moved forward or reversely so as to move the attaching member 97 upward or downward. The two lift rod 92, 94 are moved upward or downward with the upward or downward movement of the attaching member 97.

Figure 6:
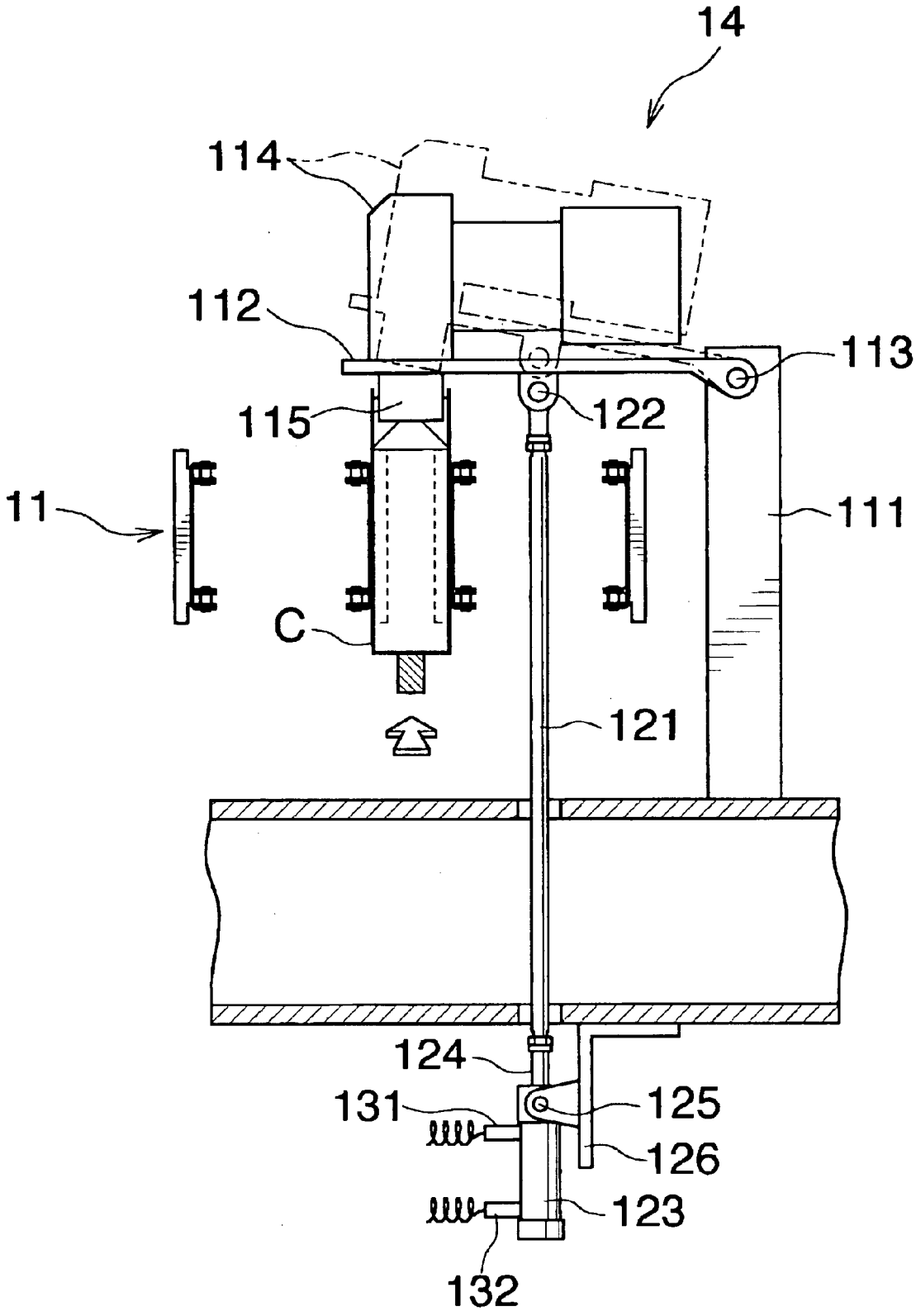
FIG. 6 is a side elevation showing the top heater in section along the line VI—VI in FIG. 1.

FIG. 6 shows the top heater 14. A vertical stand 111 is provided upright at one side of the conveyor transport path. Mounted on the upper end of the stand 111 by a horizontal pin 113 is a pivotal arm 112 movable upward or downward and having a free end positioned above the conveyor transport path. A heater unit 114 is mounted on the arm 112 and has a hot air nozzle 115 movable into the upper-end opening of the container C brought to below the unit 114.

A substantially vertical movable rod 121 has its upper end connected by a horizontal pin 122 to the arm 112 at the midportion of the length thereof. The movable rod 121 has a lower end connected to the piston rod 124 of an air cylinder 123 facing upward. The air cylinder 123 is pivotally movably attached to a support bracket 126 by a horizontal pin 125.

The air cylinder 123 is provided with a top dead center sensor 131 and a bottom dead center sensor 132 for detecting the top dead center and bottom dead center of stroke of the piston rod 124.

FIG. 6 shows the piston rod 124 in a retracted position. The arm 112 is substantially horizontal, and the hot air nozzle 115 is advanced into the upper-end opening of the container C. The required portion of the container top is heated by the application of hot air from the nozzle 115 in this state. The piston rod 124 is advanced upon completion of heating, whereby the arm 112 is pivotally moved upward along with the heater unit 114, and the nozzle 115 is retracted from the upper-end opening of the container C.

Figure 7:
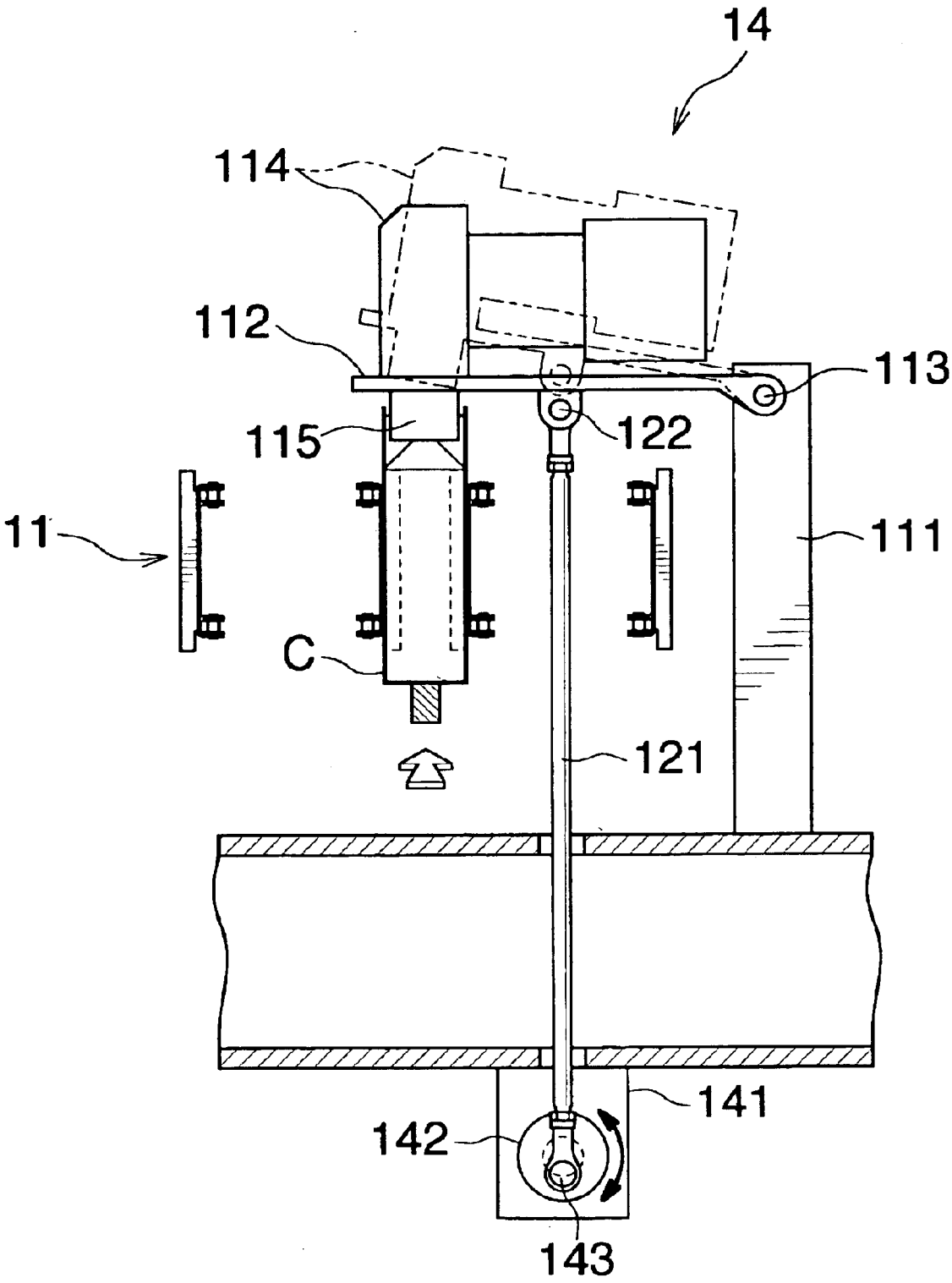
FIG. 7 is a side elevation of a top heater 14 provided with a drive device of the type different from the drive device for the top heater shown in FIG. 6.

FIG. 7 shows an embodiment wherein the air cylinder 123 shown in FIG. 6 is replaced by a rotary actuator 141. The rotary actuator 141 has an output shaft having a vertical rotating plate 142 attached thereto. The lower end of the movable rod 121 is connected by a horizontal pin 143 to the rotating plate 142 at an eccentric portion thereof.

The arm 112 is pivotally moved upward and downward along with the heater unit 114 by a movable rod 121 when the output shaft of the actuator 141 is rotated forward and reversely, through 180 deg each time.

The air cylinder 123 for driving the top heater 14 shown in FIG. 6 will be controlled by the drive system to be described below.

Figure 8:
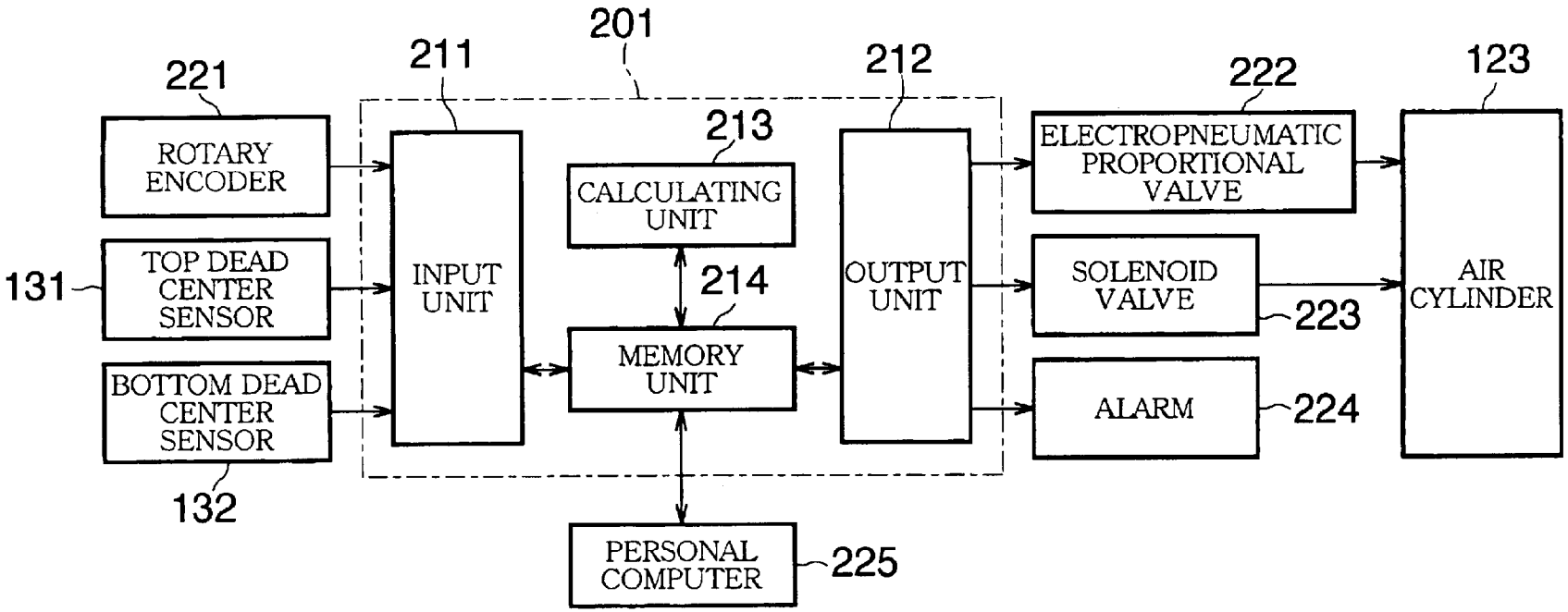
FIG. 8 is a block diagram showing the electrical construction of a drive system.

FIG. 8 shows the electrical construction of a drive system. The system has a sequencer 201, which comprises an input unit 211, output unit 212, calculating unit 213 and memory unit 214.

Input devices are connected to the input unit 211. The input devices include a rotary encoder 221 for detecting the angle of rotation of the main shaft of the packaging machine, and the top dead center sensor 131 and the bottom dead center sensor 132 provided for the cylinder 123 to be controlled. The output unit 212 has connected thereto control devices which include an electropneumatic proportional valve 222 of the flow rate type which is a control valve for controlling the flow rate of the air to be supplied to the air cylinder 123 to be controlled, a solenoid valve 223 which is an on-off valve for on/off-controlling the air to be supplied to the air cylinder 123, and an alarm 224 for giving an alarm in the event of an emergency. A personal computer 225 is connected to the memory unit 214. A program, initial values, setting values, etc. are input to the memory unit 214 via the computer 225.

Figure 9:
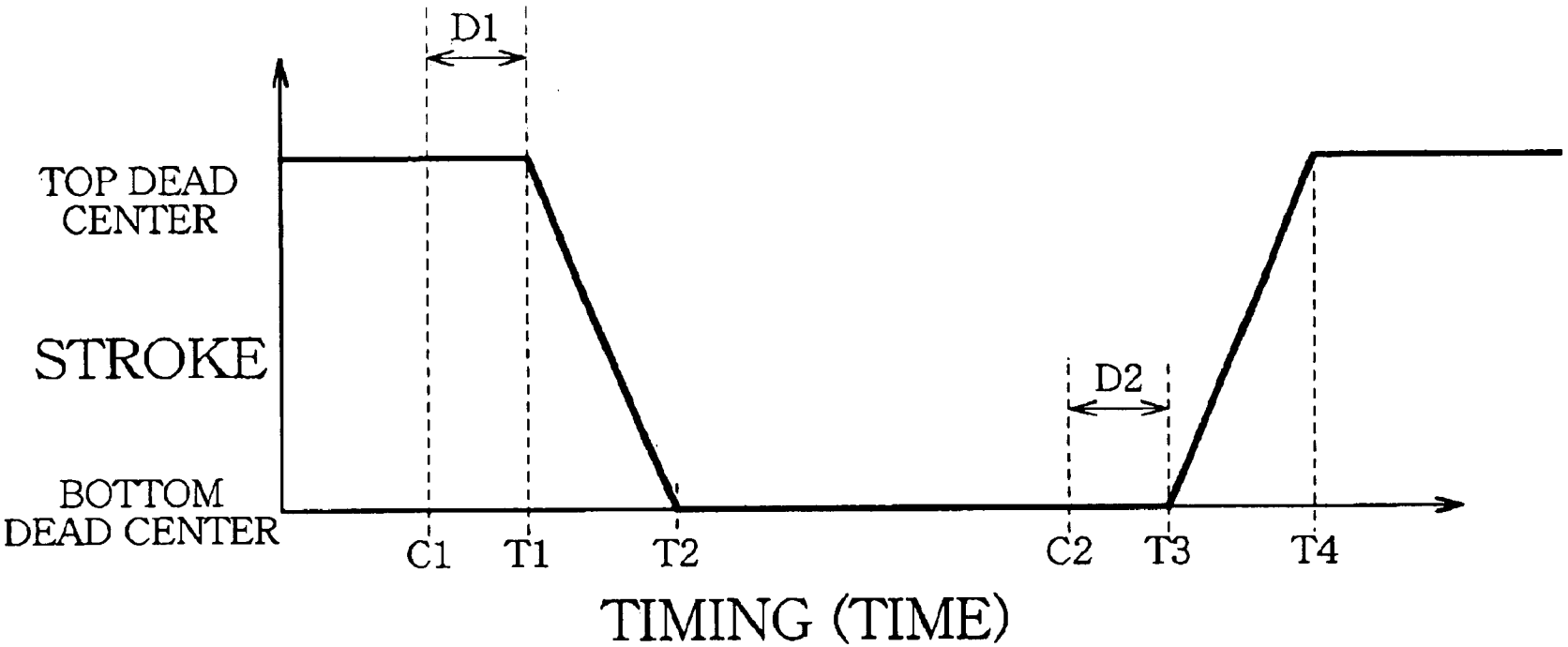
FIG. 9 is an operation diagram of an air cylinder of the drive system.

FIG. 9 is a stroke movement diagram of the cylinder, in which time (the angle of rotation of the main shaft detected by the encoder 221) is plotted as abscissa, and the cylinder stroke as ordinate. The symbols in FIG. 9 have the following meanings.

T1, T2, T3 and T4 are times to start descent, to complete descent, to start ascent and to complete ascent, respectively.

C1 and C2 are times (timing) to give a command to descend and to give a command to ascend. D1 is a delay in starting a descent at T1 after a command to descend is given at C1, and D2 is a delay in starting an ascent at T3 after a command to ascend is given at C2.

To effect a cylinder stroke movement as intended, it is necessary to determine all the four times T1, T2, T3 and T4. Instead of directly determining T1, T2, T3 and T4 individually, the descent time (T2–T1) and the ascent time (T4–T3) are determined first. Assuming that the descent time (T2–T1) and the ascent time (T4–T3) are equal to each other, the descent time (T2–T1) only is now determined.

When the descent time (T2–T1) is determined, there is no need to determine both T1 and T2, but only either one of these is determined.

In driving the top heater 14, the duration of heating by the top heater 14 is an important factor, so that the time when the top heater 14 is moved down to the bottom dead center, i.e., time T2 to complete descent, is determined.

A description will be given next of how to drive the air cylinder 123 so as to effect the stroke movement shown in FIG. 9. There are two methods of driving. One is adjustment before operation and control during operation.

An adjustment procedure will be described first.

The descent time (T2–T1) is determined by adjusting the flow rate of air to be supplied to the electropneumatic proportional valve 222. This requires an adjustment of the opening degree of the valve.

A description will now be given with reference to the flow chart of FIG. 10. Input to the memory unit 214 of the sequencer 201 are a reference value SV corresponding to a target descent time period (T2–T1), initial value V0 of valve opening degree, etc. (step 11).

Then follows step 12 in which the initial value V0 for the valve opening degree is output from the output unit 212. Subsequently, an ON command signal for the solenoid valve 223 is given (step 13). This causes the cylinder 123 to perform a stroke movement (step 14). The top dead center sensor 131 and the bottom dead center sensor 132 detect this movement (step 15), and a detected value PV is input to the input unit 211 of the sequencer 201 (step 16). The calculating unit 213 calculates the deviation of the detected value PV from the reference value SV (step 17). The deviation is compared with a target value (step 18). If the deviation is up to the target value, the determination of the descent time (T2–T1) is completed. The target value is preferably close to zero.

If the deviation is in excess of the target value, the initial value V0 for the valve opening degree is corrected, and a correct value is stored in the memory unit 214 as a new valve opening degree (step 19).

Although the corrected value may be calculated by proportional action for giving an output proportional to the deviation, PID control is preferably used which outputs proportional action plus integral action for giving an output in proportion to the integral of the deviation plus differential action for giving an output in proportion to the differential of the deviation.

The correction of the valve opening degree is followed by steps 12 to 18 again. These steps are repeated until the deviation becomes not greater than the target value.

Figure 11:
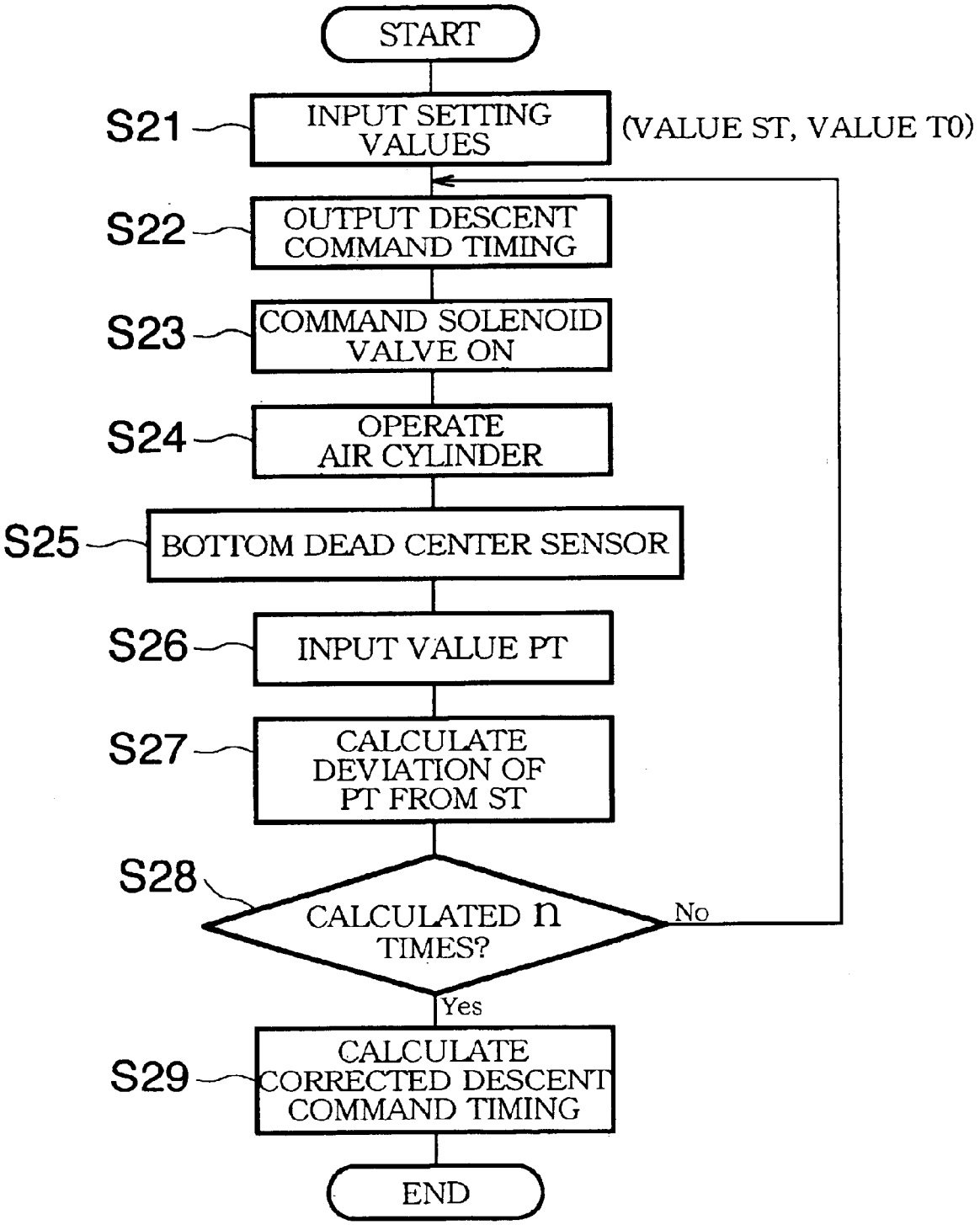
FIG. 11 is a flow chart showing a procedure for adjusting the time to give a descent command to the air cylinder.

When the descent time (T2–T1) is determined as specified by the reference value SV, the time T2 to complete the descent is determined by the procedure shown in FIG. 11.

Input to the memory unit 214 of the sequencer 201 are a reference value ST corresponding to a target time T2 to complete descent and an initial value T0 for a time C1 to give a command to descend (step 21).

When the sequence proceeds to step 22, the initial value T0 is output, and an ON command signal for the solenoid valve 223 is output with timing based on the value T0 (step 23), whereupon the air cylinder 123 is operated (step 24). Upon the cylinder rod reaching the bottom dead center, the corresponding sensor 132 detects this (step 25), and a detected value PT is fed to the input unit 211 of the sequencer 201 (step 26). The calculating unit 213 calculates the deviation of the detected value PT from the reference value ST, and the result of calculation is stored in the memory unit 214 (step 27). Step 28 then follows, in which an inquiry is made as to how many times step 26 of determining the deviation is performed. When the frequency is not greater than a prescribed number of times, e.g., up to 200, step 22 follows again, and steps 22 to 28 are repeated again.

When the frequency is in excess of a prescribed number, step 29 follows to calculate a corrected value for time C1 to give a command to descend. For the calculation of the corrected value, the average value of deviations obtained the prescribed number of times is calculated first. The initial value T0 for time C1 to give the descent command is corrected in view of the calculated average value, and the corrected value is stored in the memory unit 214 as a new time C1 to give a descent command.

The time T3 to start ascent is also adjusted in the same manner as the time T2 to complete descent. In this case, a detected value PT is obtained based on an output signal from the top dead center sensor 132.

Figure 12:
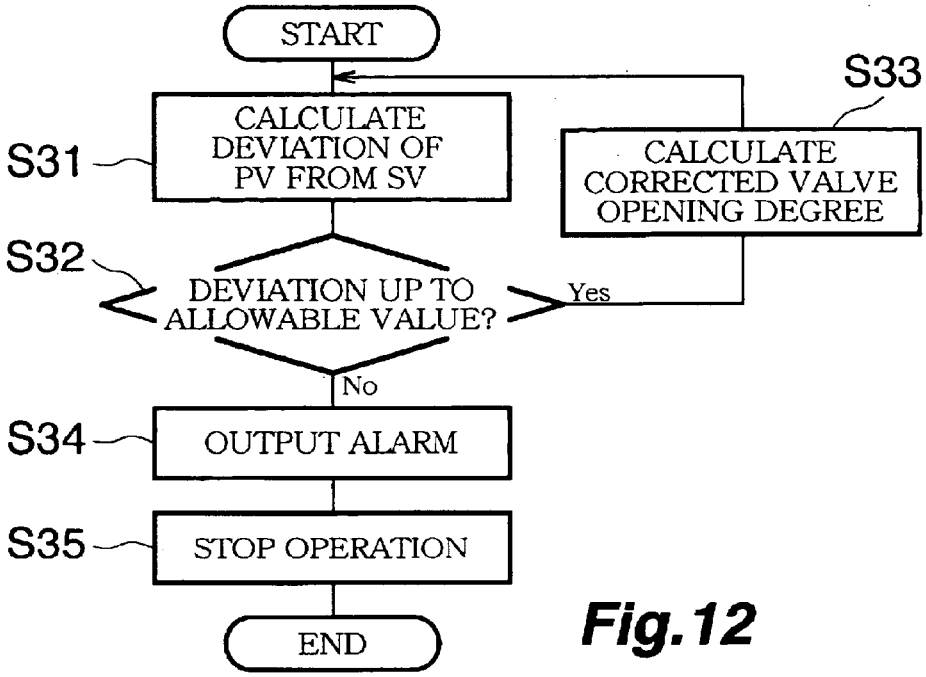
FIG. 12 is a flow chart showing a procedure for controlling the valve opening degree for the air cylinder.

The adjustment is thus completed. Next, a procedure for controlling the valve opening degree during operation will be described with reference to FIG. 12.

Figure 10:
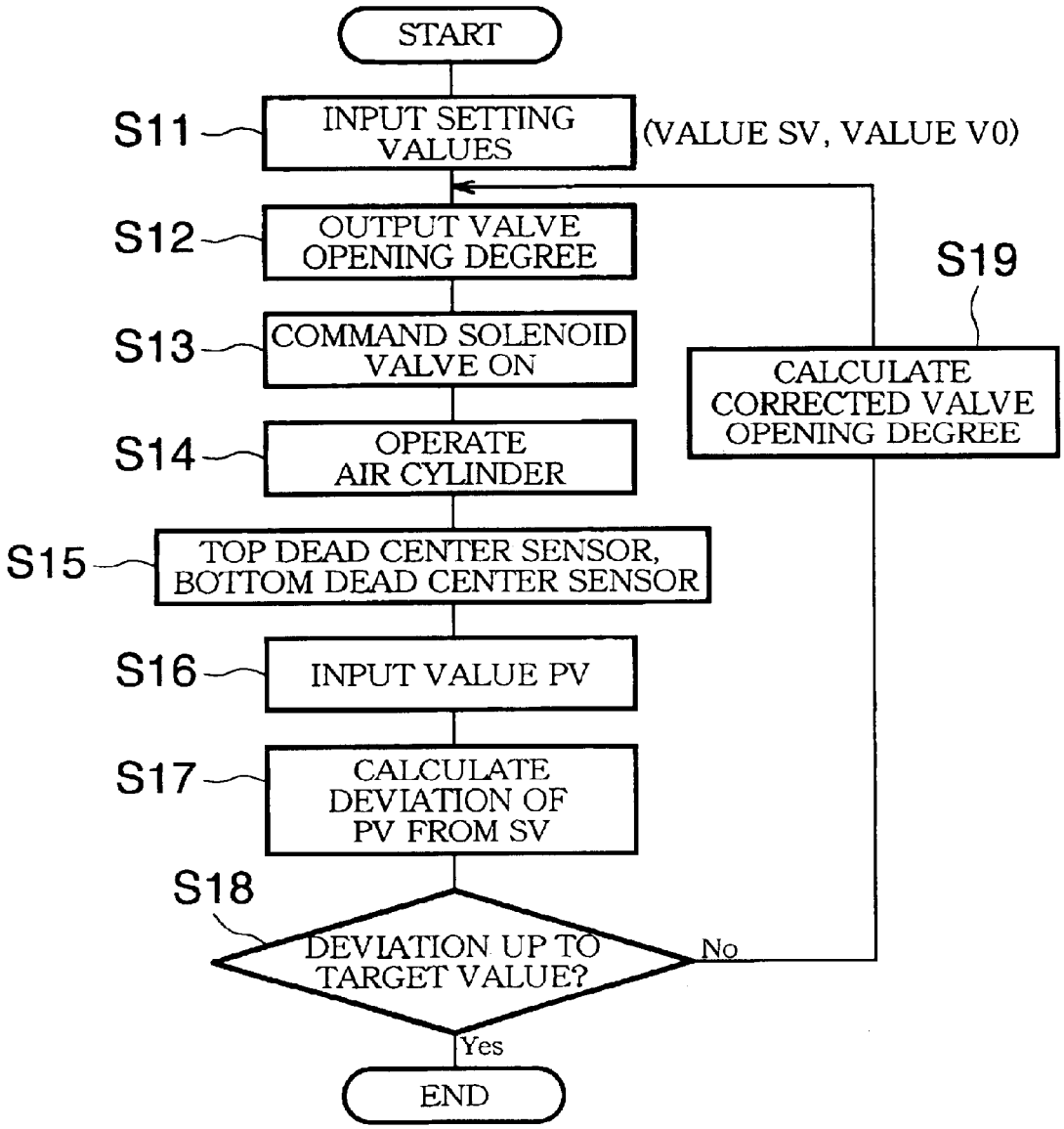
FIG. 10 is a flow chart showing a procedure for adjusting the opening degree of a valve for the air cylinder.

The deviation of a detected value PV from the reference value SV is determined in the same manner as steps 11 to 17 shown in FIG. 10. The deviation obtained is checked this time as to whether it is not greater than an allowable value (step 32) instead of being compared with the target value. If the deviation is up to the allowable value, step 33 follows to calculate a corrected value for the valve opening degree in the same manner as in FIG. 10, step 19.

When the deviation is in excess of the allowable value, an alarm is given (step 34), and the apparaus is brought out of operation (step 35).

Figure 13:
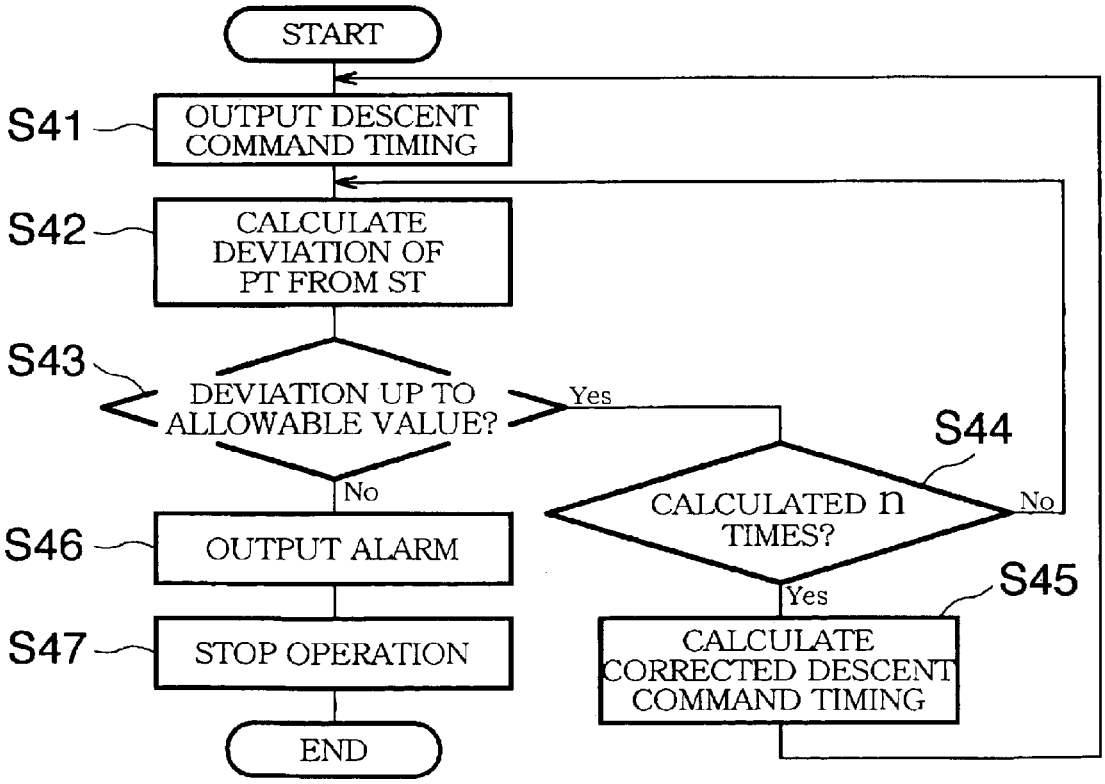
FIG. 13 is a flow chart showing a procedure for controlling the time to give a descent command to the air cylinder.

FIG. 13 shows a procedure for controlling time C1 to give a command to descend. Time C1 to give the descent command is output from the memory unit 214 of the sequencer 201 in step 41. In step 42, the deviation of a detected value PT from the reference value ST is calculated in the same manner as FIG. 11, steps 23 to 27, and the result of calculation is stored in the memory unit 214. An inquiry is made as to whether the deviation is not greater than an allowable value (step 43). If the deviation is not greater than the allowable value, step 44 follows, in which an inquiry is made as to whether the calculation of the deviation is made at least a prescribed number of times. If the number is not greater than the prescribed number, step 42 follows again, whereas if the number is in excess of the prescribed number, the time to give the descent command is corrected in step 45 in the same manner as FIG. 11, step 29. The sequence thereafter returns to step 41.

If the deviation is in excess of the allowable value, an alarm is given (step 46), and the device is brought out of operation (step 47).

Time C2 to give a command to ascend is controlled in the same manner as time C1.

Although adjustment before operation and control during operation are described above, at least one of these procedure may be performed.

While the method of determining all the times T1 to T4 is described, some of T1 to T4 may be selected according to the importance of movement of the operating member.

Although the sensors provided for the cylinder are used in the above procedures, such sensors may be provided at any location insofar as the operation of the actuator can be detected as in the case of the operating member.

What is claimed is:

1. In a packaging machine having an operating member for a packaging operation, a drive device comprising:

a fluid pressure actuator for causing the operating member to perform a reciprocating motion, a sensor for detecting the cycle velocity or time of the actuator, a control valve for controlling the pressure or flow rate of a fluid to be supplied to the actuator, and control means for setting a reference value corresponding to the cycle velocity or time of the actuator, receiving a value detected by the sensor as an input, calculating a valve opening degree based on the deviation of the detected value from the reference value and setting the calculated valve opening degree as the opening degree of the control valve.

2. In a packaging machine having an operating member for a packaging operation, a drive device comprising:

a fluid pressure actuator for causing the operating member to perform a reciprocating motion, a sensor for detecting cycle timing of the actuator, an on-off valve for on/off-controlling a fluid to be supplied to the actuator, and control means for setting a reference value corresponding to the cycle timing of the actuator, receiving a value detected by the sensor as an input, calculating cycle timing based on the deviation of the detected value from the reference value and setting the calculated cycle timing as the cycle timing of the on-off valve.

3. In a packaging machine having an operating member for a packaging operation, a drive device comprising:

a fluid pressure actuator for causing the operating member to perform a reciprocating motion, a sensor for detecting cycle timing of the actuator, an on-off valve for on/off-controlling a fluid to be supplied to the actuator, calculating means for setting a reference value corresponding to the cycle timing of the actuator, receiving a value detected by the sensor as an input and calculating the deviation of the detected value from the reference value every cycle, and control means for calculating the average value of the deviations of a plurality of cycles calculated by the calculating means, calculating cycle timing based on the calculated average value and setting the calculated cycle timing as the cycle timing of the on-off valve.

4. In a packaging machine having an operating member for a packaging operation, a drive device comprising:

a fluid pressure actuator for causing the operating member to perform a reciprocating motion, a sensor for detecting the cycle velocity or time of the actuator and detecting cycle timing of the actuator, a control valve for controlling the pressure or flow rate of a fluid to be supplied to the actuator, an on-off valve for on/off-controlling the fluid to be supplied to the actuator, control means for setting an operating time reference value corresponding to the cycle velocity or time of the actuator and a timing reference value corresponding to the cycle timing of the actuator, receiving an operating time value and a timing value detected by the sensor as inputs, calculating a valve opening degree based on the deviation of the detected operating time value from the operating time reference value and cycle timing based on the deviation of the detected timing value from the timing reference value, and setting the calculated valve opening degree as the opening degree of the control valve and the calculated cycle timing as the cycle timing of the on-off valve.

5. A drive device according to any one of claims 1 to 4 wherein the fluid pressure actuator is an air cylinder or a rotary actuator.

6. A drive device according to any one of claims 1 to 4 wherein the operating member is one of a piston rod of a fluid pressure cylinder, a container lift rod of a lifter and a movable rod of a top heater for pivotally moving a heater unit.

* * * * *